United States Patent [19]

Savage

[11] 4,253,521

[45] Mar. 3, 1981

[54] SETTING TOOL

[75] Inventor: Ronald E. Savage, Duncan, Okla.

[73] Assignee: Halliburton Company, Duncan, Okla.

[21] Appl. No.: 953,941

[22] Filed: Oct. 23, 1978

[51] Int. Cl.[3] ..... E21B 23/00

[52] U.S. Cl. ..... 166/123; 166/125; 166/128

[58] Field of Search ..... 166/128, 123, 125, 332, 166/323, 217; 251/79

[56] References Cited

U.S. PATENT DOCUMENTS

| | | | |
|---|---|---|---|
| 2,397,473 | 4/1946 | Crowell | 166/128 |
| 3,457,994 | 7/1969 | Stachowiak | 166/128 |
| 3,831,677 | 8/1974 | Mullins | 166/128 |
| 4,077,473 | 3/1978 | Watkins | 166/323 |

*Primary Examiner*—William F. Pate, III

*Attorney, Agent, or Firm*—John H. Tregoning; James R. Duzan; Lucian Wayne Beavers

[57] ABSTRACT

The present invention provides a setting tool having a tubular sleeve assembly. An upper mandrel is disposed within said sleeve assembly and interconnected therewith by a rotational screw jack means. A lower mandrel is connected to the upper mandrel by a load transfer device for governing a maximum downward force which can be applied to the lower mandrel when the setting tool is set down on a packer. The load transfer means includes a casing connected to the upper mandrel, said casing having a support surface for engagement with an upper end of a packer mandrel. Resilient spring means is provided between the casing and the lower mandrel, and is constructed so that when said support surface is in engagement with said packer mandrel, a downward force applied to said lower mandrel must be transmitted through said resilient spring means. The maximum downward force which can be applied to the lower mandrel, and correspondingly to a sliding sleeve of the packer, is equal to a force required to fully compress said resilient spring means. Also, an improved releasable locking means is provided between the upper mandrel and the sleeve assembly so that the sleeve assembly may be released to allow free rotational and axial motion of the upper mandrel relative to the sleeve assembly.

16 Claims, 13 Drawing Figures

SETTING TOOL

This invention relates generally to setting tools for packers, and more particularly, but not by way of limitation, to setting tools including a load transfer means.

In the drilling or reworking of oil wells, it is often desirable to seal between one oil well flow conductor, such as tubing or other pipe, and another flow conductor, such as the well casing in which the tubing is telescoped. Such a seal is provided by a packer.

One particular type of packer which is known to the prior art is a squeeze packer. A squeeze packer includes a mandrel having upper and lower slip assemblies connected thereto with expandable packer elements located between the slip assemblies. A tension sleeve is threadedly engaged with an upper end of the packer mandrel. The packer includes a valve means having an internal sliding sleeve located within a bore of the packer mandrel.

Such a squeeze packer has previously been actuated by a tool known as a setting tool. Setting tools of the prior art include a stinger means or lower mandrel for engagement with the sliding valve sleeve, a tubular setting sleeve for engagement with the upper slip assembly of the packer to set said upper slip assembly, drag springs connected to the setting sleeve, and a screw jack means for producing axial motion of said setting sleeve relative to said stinger means when a drill string to which the setting tool is attached is rotated. The prior art setting tool also includes a threaded connection to a tension sleeve of the packer. Squeeze packers are operated by the setting tools of the prior art in the following manner.

The setting tool is made up to the end of a drill string. The packer is threadedly connected to the setting tool. Then, the drill string, setting tool and packer are run into the oil well casing until the desired location of the packer is reached.

Then, the drill string is rotated a first predetermined number of revolutions, thereby moving the setting sleeve downward relative to the stinger means so that the setting sleeve engages the upper slip assembly of the packer to set the same against the inner bore of the casing.

After the upper slip assembly is set, the drill string is pulled upward to expand the packer elements and to set the lower slip assembly. After the lower slip assembly is set, the tension sleeve is further loaded in tension until it fails, thereby separating the setting tool from the packer.

The setting tool is then set back down until the setting sleeve once again engages the upper slip assembly and the tubing is pressure tested.

Next, the setting tool is lifted up until the stinger means is pulled out of engagement with the packer. Then, the drill string is rotated through a second predetermined number of revolutions to actuate a means for releasing the setting sleeve so that the setting sleeve is free to move in an axial direction relative to the stinger means.

Then, the drill string is once again set down to engage the stinger means with the sliding valve sleeve of the packer to move the sliding valve sleeve downward to open the packer valve.

Using the apparatus of the prior art, the entire load set down on the packer is transmitted to the sliding valve sleeve by the stinger means. The sliding valve sleeve in turn transmits that load to a point near the lower end of the packer mandrel.

The packer mandrel itself it supported from the well casing through the upper slip assembly. This, therefore, puts a portion of the packer mandrel, located between the upper slip assembly and the point of support of the valve sleeve, into tension.

The squeeze packers, with which the present invention is concerned, have a mandrel manufactured from cast iron. The load carrying capabilities of cast iron in tension are very much inferior to the load carrying capabilities of that material in compression. The tensile loads which can be carried by the cast iron packer mandrel are on the order of twenty to thirty thousand pounds. In a very deep oil well, having a depth of greater than ten thousand feet, it is very difficult to accurately control the amount of weight which is set down on the packer when actuating the valve sleeve. It very often happens, with the setting tool of the prior art, that an excess amount of weight is set down on the packer causing the packer mandrel to fail due to the excess tension loading.

The load carrying capabilities of the cast iron mandrel are very much greater in compression than in tension. It is, therefore, desirable to have a setting tool which engages the packer in such a manner so that the weight of the drill string is carried by the packer mandrel in compression rather than in tension. Such a setting tool is provided by the present invention.

Typical packers and setting tools of the prior art are shown in U.S. Pat. No. 3,163,225 to Perkins and U.S. Pat. No. 2,589,506 to Morrisett. Neither of those references discloses a setting tool having a means for transferring the weight of the drill string to the packer mandrel in a compression loading. Additionally, the packer 12, described in detail in the following disclosure, is part of the prior art.

As mentioned above, after the slip assemblies of the squeeze packer have been set, it is necessary to release the setting sleeve so that the stinger means may be extended axially relative to the setting sleeve in order to engage the sliding valve sleeve. It is also desirable, when so releasing the setting sleeve, to release it to allow rotational motion of the stinger means relative to the setting sleeve. The present invention includes an improved releasing means for allowing both axial and rotational motion.

The present invention provides a setting tool having a tubular sleeve assembly. An upper mandrel is disposed within said sleeve assembly and interconnected therewith by a rotational screw jack means. A lower mandrel is connected to the upper mandrel by a load transfer means for governing a maximum downward force which can be applied to the lower mandrel when the setting tool is set down on a packer. The load transfer means includes a casing connected to the upper mandrel, said casing having a support surface for engagement with an upper end of a packer mandrel. Resilient spring means is provided between the casing and the lower mandrel, and is constructed so that when said support surface is in engagement with said packer mandrel, a downward force applied to said lower mandrel must be transmitted through said resilient spring means. The maximum downward force which can be applied to the lower mandrel, and correspondingly to a sliding sleeve of the packer, is equal to a force required to fully compress said resilient spring means. Also, an improved releasable locking means is provided between the upper mandrel and the sleeve assembly so that the sleeve assembly may be released to allow free rotational and axial motion of the upper mandrel relative to the sleeve assembly.

FIGS. 1A, 1B, 1C, 1D and 1E comprise a sectional elevation view of the setting tool of the present invention engaged with a packer, progressing from the top of the tool in FIG. 1A to the bottom of the packer in FIG. 1E.

Figure 1A:
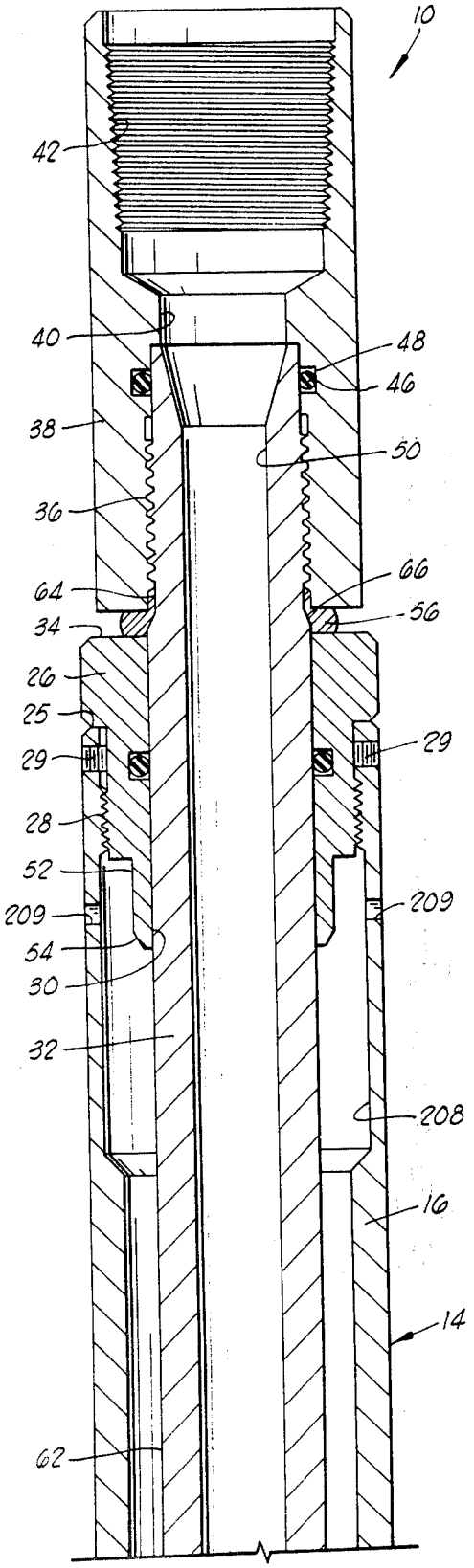

Referring now to the drawings, and particularly to FIGS. 1A-E, the setting tool of the present invention is shown and generally designated by the numeral 10. The setting tool 10 is shown connected with a packer 12 which may generally be referred to as a downhole mechanism. Setting tool 10 provides a means for actuating packer 12.

The setting tool 10 includes a tubular sleeve assembly 14 including a releasing sleeve 16, a drag spring body 18 and a setting sleeve 20. A lower end 17 of releasing sleeve 16 and an upper end 19 of drag spring body 18 are threadedly connected at threaded connection 22. Set screws 15 are disposed through the walls of releasing sleeve 16 and engage drag spring body 18 to prevent rotation of releasing sleeve 16 relative to drag spring body 18 after the two are assembled. A lower end 21 of drag spring body 18 and an upper end 23 of setting sleeve 20 are connected at threaded connection 24.

A cap means 26 is threadedly connected to an upper end 25 of releasing sleeve 16 at threaded connection 28. Set screws 29 are disposed through the walls of releasing sleeve 16 and engage cap 26 to prevent rotation of the cap 26 relative to sleeve 16 after the two are assembled. Cap 26 has an axial bore 30 disposed therethrough which closely receives an upper mandrel 32. Upper mandrel 32 projects a distance above an upper end surface 34 of cap 26, and is connected at threaded connection 36 to an upper end adapter 38.

Upper end adapter 38 is a cylindrical member having an axial bore 40 therethrough with an upper threaded counterbore 42 constructed for connection with a string of drilling tube (not shown).

A resilient O-ring seal 46 is disposed in radially inner annular groove 48 of adapter 38 to seal between upper mandrel 32 and adapter 38. An inner bore 50 of upper mandrel 32 communicates with bore 40 of adapter 38.

Cap means 26 is cylindrical and includes a lower reduced diameter portion 52 having an annular wedge means 54 formed thereon. A resilient seal 56 is disposed between adapter 38 and cap 26 about upper mandrel 32.

Upper mandrel 32 is a cylindrical member having a cylindrical outer surface 58 near a lower end 60 thereof. Upper mandrel 32 includes first and second successive reduced diameter portions 62 and 64, respectively. First reduced diameter portion 62 is located above and adjacent cylindrical surface 58, and second reduced diameter portion 64 is located above and adjacent first reduced diameter portion 62. A sloped upward facing annular shoulder 66 first and second reduced diameter portions 62 and 64. Six flats 67, radially spaced 60° apart, are milled in an upper portion of first reduced diameter portion 62 of upper mandrel 32.

Figure 1B:
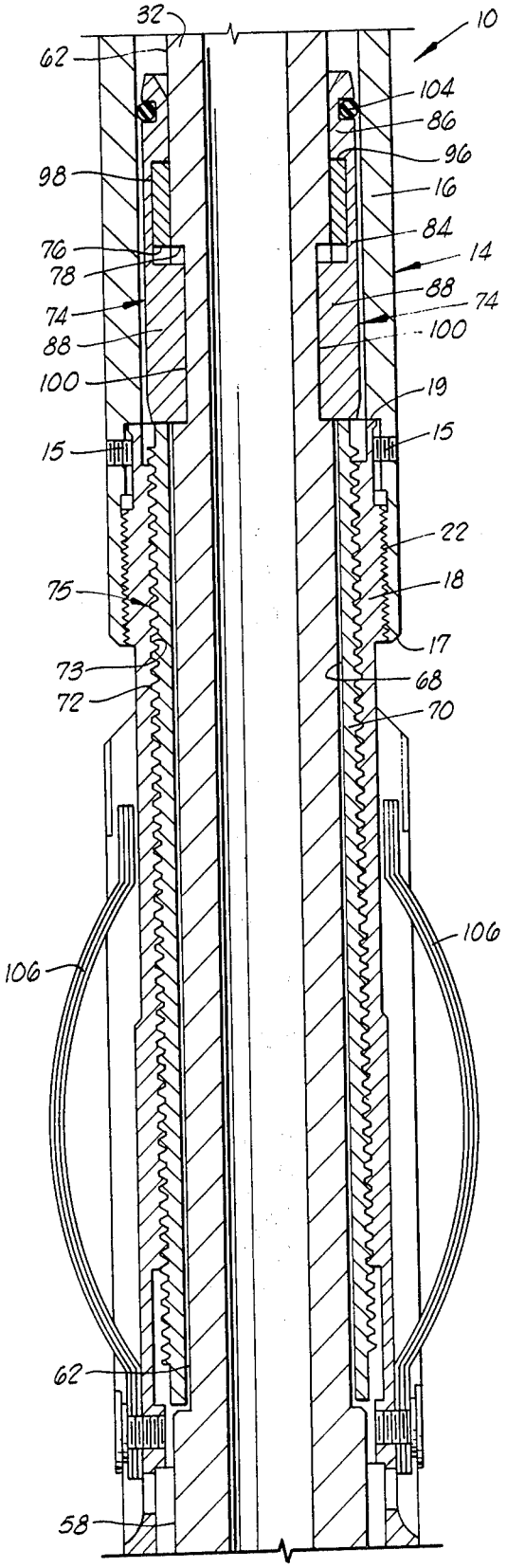
Figure 1C:
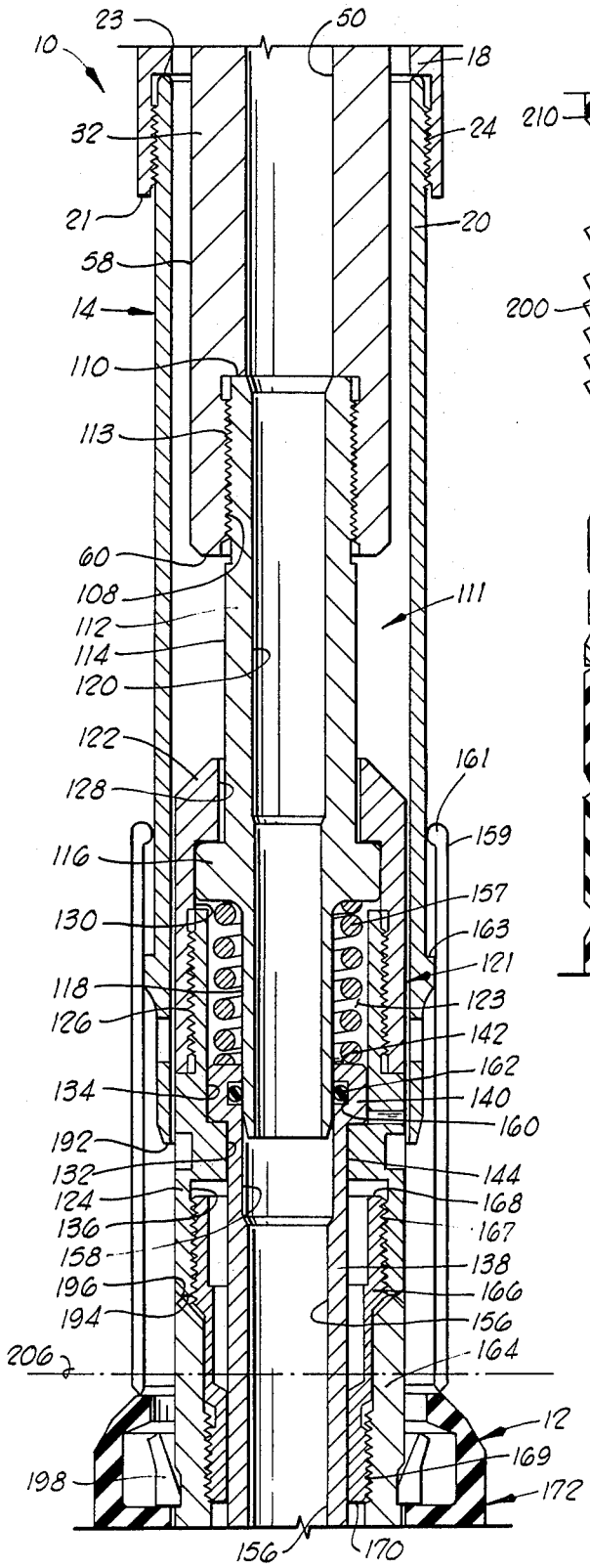
Figure 1D:
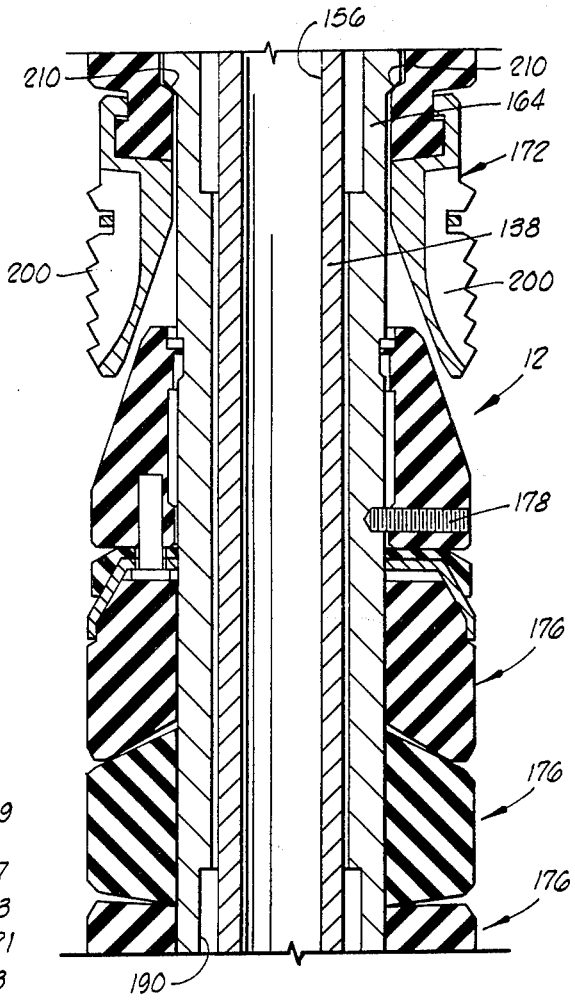

First reduced diameter portion 62 of upper mandrel 32 is shown in FIG. 1B as being substantially completely received within an inner bore 68 of screw jack bushing 70.

A radially outer surface of screw jack bushing 70 comprises a left hand Acme threaded portion 72, said threaded portion 72 having an axial length of approximately ten inches and including approximately sixty revolutions of the thread.

A radially inner surface of drag spring body 18 includes a complementary left hand Acme screw jack thread 73 engaging threaded outer surface 72 of bushing 70. Screw jack bushing 70 and drag spring body 18, as connected by Acme threads 72 and 73, respectively, comprise a left hand screw jack means 75 for producing axial motion of drag spring body 18 downward relative to screw jack bushing 70, when screw jack bushing 70 is rotated clockwise as viewed from above, relative to drag spring body 18.

Screw jack bushing 70 and upper mandrel 32 are releasably interlocked by a plurality of radially spaced keys 74. The keys 74 are illustrated in detail in FIGS. 6–9. The keys 74 project through axial slots 76, of screw jack bushing 70, into axial grooves 78 of upper mandrel 32. Keys 74 provide a locking means connected between upper mandrel 32 and said screw jack means 75 for preventing axial sliding movement and rotation of upper mandrel 32 relative to tubular sleeve assembly 14. The axial slots 76, of screw jack bushing 70, are aligned with axial grooves 78.

Referring now to FIGS. 6–9, keys 74 include relatively thin arcuate axially middle portions 84 having upper and lower radially inward projecting lugs 86 and 88, connected to upper and lower ends, respectively, thereof.

Upper lug 86, middle part 84 and lower lug 88 of keys 74 are all arcuate shaped and include arcuate radially inner surfaces 90, 92 and 94, respectively.

Upper lugs 86 project over an upper end 96 of screw jack bushing 70 and arcuate surfaces 90 engage first reduced diameter portion 62 of upper mandrel 32.

Radially inner surface 92 of middle part 84 of keys 74 closely engages a nonthreaded radially outer surface 98 of bushing 70, located above axial slots 76.

Lower lugs 88 project through axial slots 76 into axial grooves 78 to engage radially inner surfaces 100 of axial grooves 78. It is the lower lugs 88 which interlock bushing 70 with upper mandrel 32. Axial movement between bushing 70 and mandrel 32 is prevented due to engagement of lower lugs 88 with the upper and lower surfaces of upper and lower annular grooves 80 and 82, respectively. Radial motion between bushing 70 and upper mandrel 32 is prevented by engagement by lower lugs 88 with radially outward projecting lugs 84 of upper mandrel 32.

Upper lugs 86 have an arcuate groove 102 disposed in a radially outer surface thereof. An annular retaining band 104, which preferably is a resilient O-ring, is disposed about keys 74 in grooves 102 to urge said keys 74 radially inward.

Drag spring body 18 has a plurality of radially outward projecting resilient drag springs 106 attached thereto. Drag springs 106 resiliently engage an inner bore of a casing (not shown) of the oil well to prevent rotational motion of the drag spring body 18 within the casing.

A load transfer means generally designated by the numeral 111 is threadedly connected to lower counterbore 108 of upper mandrel 32. Load transfer means 111 is a means for governing a maximum downward force which can be applied to a lower mandrel 138. Upper mandrel 32 has threaded internal counterbore 108 at its lower end which is connected to upper end 110 of a load transfer mandrel 112, at threaded connection 113.

Load transfer mandrel 112 includes an upper cylindrical portion 114, a middle radially outward projecting shoulder means 116 located below said upper portion 114, and a lower cylindrical portion 118 located below said shoulder 116. Load transfer mandrel 112 has an axial bore 120 therethrough for communication with the inner bore 50 of upper mandrel 32.

Load transfer means 111 further includes a casing 121 having upper and lower casing portions 122 and 124, respectively. Upper and lower casing portions 122 and 124 are threadedly connected at threaded connection 126.

Upper casing portion 122 has an axial bore 128 therethrough receiving said upper cylindrical portion 114 of load transfer mandrel 112. Upper casing portion 122 also includes a lower axial counterbore 130 receiving said shoulder 116 of load transfer mandrel 112. An inner cavity 123 of casing 121 communicates with a lower end thereof. Lower cylindrical extension 118 of load transfer mandrel 112 extends axially downward within cavity 123, from an upper end of said casing.

Lower casing portion 124 has an axial bore 132 and further includes upper and lower counterbores 134 and 136, respectively.

Lower mandrel or stinger means 138 includes a radially outward projecting flange 140 at a first upper end 142 thereof. Lower mandrel 138 may also be referred to as an actuating mandrel. A cylindrical outer surface 144 of lower mandrel 138 is received in said axial bore 132 of lower casing portion 124, and said flange 140 is received in said upper counterbore 134 of said lower casing portion 124.

Said lower mandrel 138 further includes, at a second lower end 146 thereof, a packer valve engaging means 148. Valve engaging means 148 includes a reduced diameter portion 150 of lower mandrel 138 forming an upward facing annular shoulder 152 for engagement with a sliding valve sleeve 154 of packer 12.

Said lower mandrel 138 has an axial bore 156 therethrough with an upper counterbore 158 for closely receiving said lower cylindrical portion 118 of load transfer mandrel 112.

Resilient coil spring means 157 is disposed concentrically about extension 118 between said radially outward projecting shoulder means 116 of said load transfer mandrel 112 and said flange 140 of lower mandrel 138, for urging said lower mandrel 138 downward relative to said load transfer mandrel 112.

Lower mandrel 138 includes an annular groove 160 containing an O-ring 162 sealing between said counterbore 158 and lower cylindrical portion 118 of load transfer mandrel 112.

A cylindrical junk shield 159 slidably engages setting sleeve 20, for preventing debris from fouling the interworking components of releasing sleeve 20, load transfer means 111 and packer 12. Junk shield 159 includes a radially inward projecting lip 161 for engagement with radially outward projecting shoulder 163 of releasing sleeve 20.

Some of the details of construction of packer 12 will now be described. Packer 12 includes a cast iron packer mandrel 164. An upper end 168 of a brass tension sleeve 166 is connected to lower casing portion 124 at threaded connection 167. A lower end 170 of tension sleeve 166 is connected to packer mandrel 164 at threaded connection 169.

Connected to packer mandrel 164 is an upper slip assembly 172 and a lower slip assembly 174. Expandable packing elements 176 are located between upper and lower slip assemblies 172 and 174.

An upper shear screw 178 is located between upper slip assembly 172 and the expandable packing elements 176. A lower shear screw 180 is located between packing elements 176 and lower slip assembly 174.

Packer mandrel 164 includes mandrel ports 182 disposed therethrough. Sliding valve sleeve 154 includes valve sleeve ports 184 arranged for alignment with packer mandrel ports 182 when sliding valve sleeve 154 is in an open position as shown in FIG. 1E.

Sliding packer valve sleeve 154 includes a plurality of upward extending fingers 186 having radially outer ridges 188 for engagement with an increased inner diameter portion 190 of packer mandrel 164. When valve sheets 154 is moved axially upward, relative to packer mandrel 164 to a closed position, ridges 188 are received in increased inner diameter portion 190 and engage an annular shoulder 191.

OPERATION OF THE SETTING TOOL

Figure 1E:
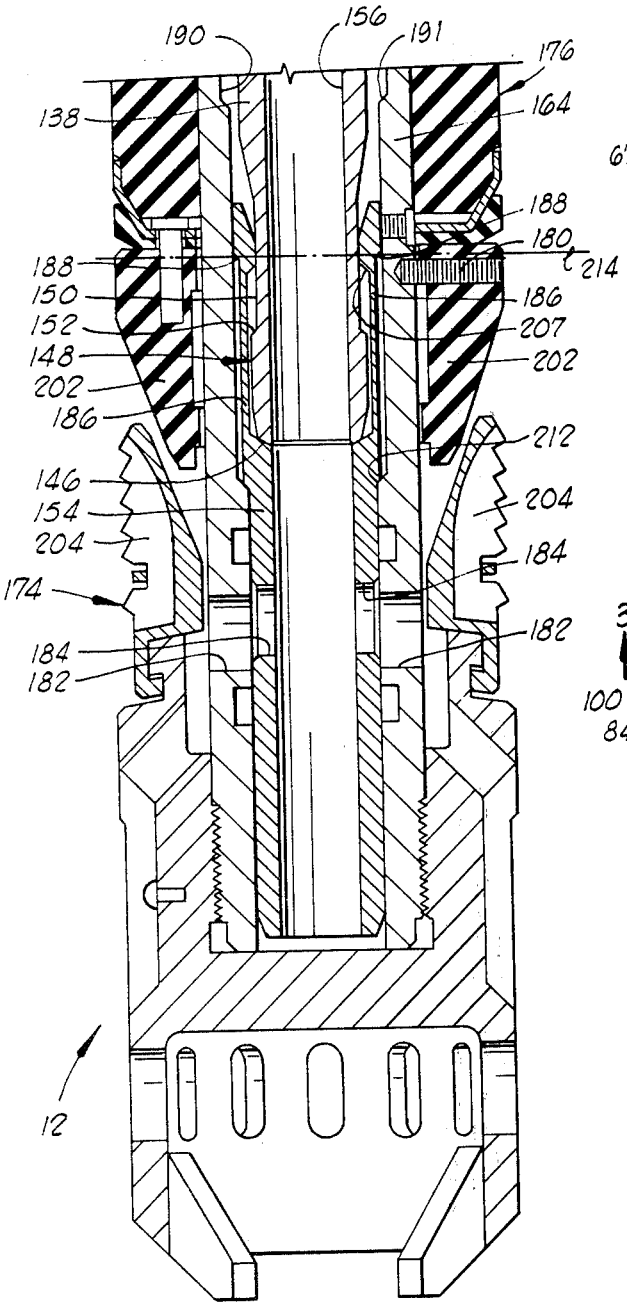
Figure 2:
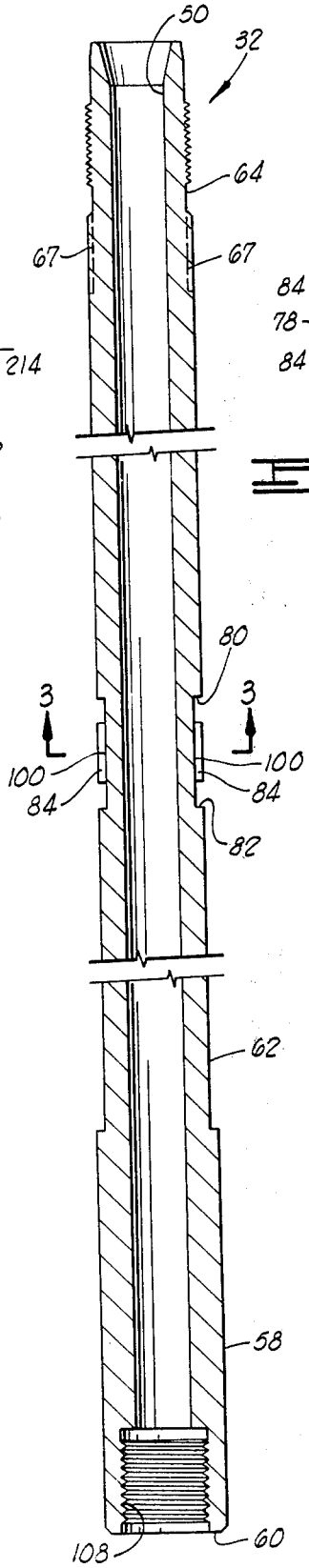
FIG. 2 is a sectional elevation view of the upper mandrel of the setting tool of FIG. 1.
Figure 3:
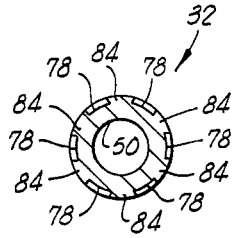
FIG. 3 is a sectional view of the upper mandrel of FIG. 2 taken along lines 3—3.
Figure 4:
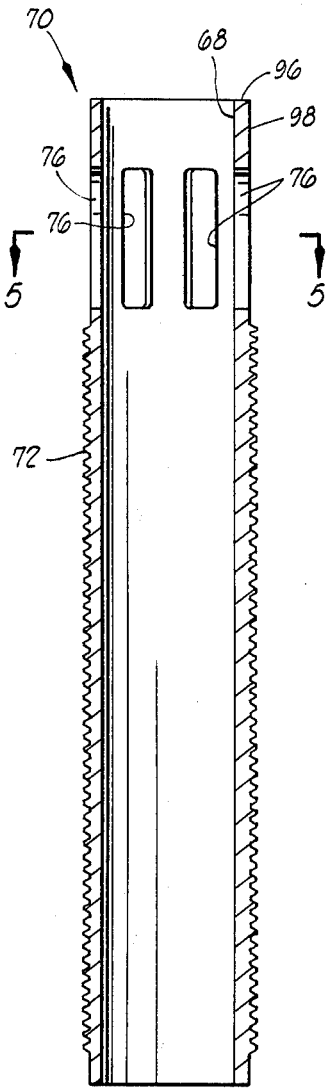
FIG. 4 is a sectional elevation view of the screw jack bushing of the setting tool of FIG. 1.
Figure 6:
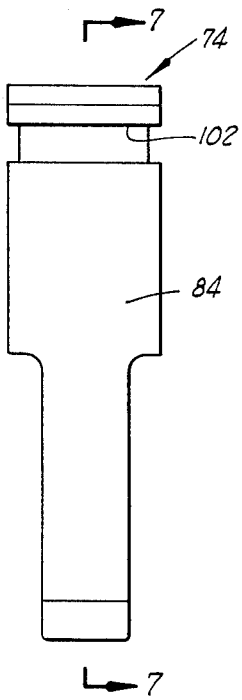
FIG. 6 is a radially outer elevation view of a key of the setting tool of FIG. 1.
Figure 7:
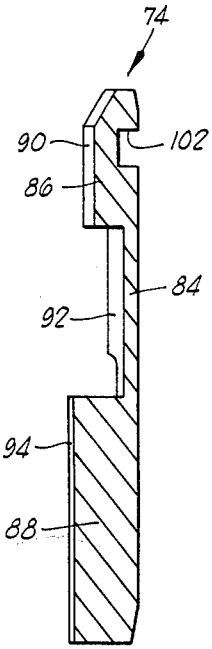
FIG. 7 is a sectional elevation view of the key of FIG. 6 taken along lines 7—7.
Figure 8:
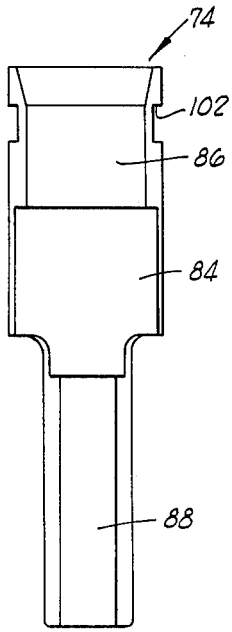
FIG. 8 is a radially inner elevation view of the key of FIG. 6.
Figure 9:
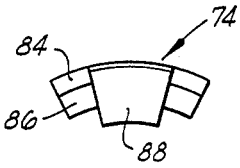
FIG. 9 is a lower end view of the key of FIG. 6.
Figure 5:
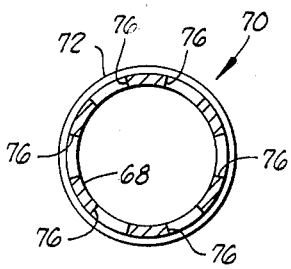
FIG. 5 is a sectional view of the bushing of FIG. 4 taken along lines 5—5.

The setting tool 10 of the present invention provides an actuating device which can both set the packer 12 and then selectively open and close the valve means of the packer 12 by varying sliding valve sleeve 154 between an open position as shown in FIG. 1E and a closed position (not shown) with ridges 188 engaging shoulder 191.

The setting tool 10 and packer 12 are made up with each other as shown in FIGS. 1A–E. Upper threaded counterbore 42 of adapter 38 is connected to a lower end of a drill string, (not shown). Note that in this position the internal threaded portion 73 of drag spring body 18 is fully engaged with the external Acme thread portion 72 of screw jack bushing 70. A lower end 192 of the setting sleeve 20 is located above a lower end 194 of lower casing portion 124. Lower end 194 may also be referred to as an annular downward facing support surface. Lower casing portion 124 is fully made up with tension sleeve 166 at threaded connection 167 so that lower end or annular support surface 194 of lower casing 124 engages an annular upper end portion 196 of packer mandrel 164.

The assembly shown in FIGS. 1A–E is then run into the oil well casing (not shown) until the packer 12 is located at the desired depth.

Then, the drill string and the upper mandrel 32 and the screw jack bushing 70 are rotated clockwise through a first predetermined number of revolutions, e.g. thirty-five revolutions in the preferred embodiment illustrated in FIGS. 1A–E, to move tubular sleeve assembly 14 axially downward relative to upper mandrel 32 until setting sleeve 20 engages a split ring 198 of upper slip assembly 172, thereby providing a wedging motion which forces the upper slips 200 radially outward so that they are set against the inner bore of the casing, as will be understood by those skilled in the art. Once the upper slip assembly 172 is set against the oil well casing, the packer 12 is then fixed against upward axial movement within the casing.

Then, the drill string and setting tool 10 are pulled upward. This exerts a tensile force on tension sleeve 166 which transmits said tensile force to packer mandrel 164. The packer mandrel 164 is being urged upwards and when a sufficient upward force is reached, the upper shear screw 178 will shear. Then, the continuing upward pull on the packer mandrel 164 moves the mandrel 164 upwards relative to upper slip assembly 172, thereby compressing and expanding packing elements 176 to provide a seal against the inner bore of the oil well casing. Next, lower shear screw 180 shears, allowing lower slip assembly 174 to be pulled upwards relative to lower wedges 202, to force lower slips 204 radially outward so that they too engage the inner bore of the oil well casing. Lower slips 204 fix the packer 12 against axial motion downward relative to the oil well casing. Finally, with ever increasing upward force being exerted on the drill string, the tension sleeve 166 is pulled apart. Tension sleeve 166 fails across a plane indicated by the numeral 206.

Upon failure of the tension sleeve 166, the setting tool 10 is pulled axially upward relative to packer 12 so that upward facing shoulder 152 of lower mandrel 138 engages inner ridges 207 of valve sleeve fingers 186, thereby pulling sliding valve sleeve 154 axially upward within packer mandrel 164 to the closed position of the sliding valve sleeve.

The packer 12 has now been set and the packer valve is closed. The next step which is normally carried out is to pressure test the drill string tubing prior to performing a cementing operation or other operation.

To pressure test the drill string tubing, the setting tool 10 is lowered until setting sleeve 20 once again engages split ring 198 of packer 12. The lower mandrel 138 of setting tool 10 is once again received within the packer mandrel 164. The sliding sleeve valve 154 is still in its closed position.

Then, the drill string tubing is pressurized to test the same for leaks.

Once it has been determined that there are no leaks in the drill string tubing or within the setting tool 10 or packer 12, it is necessary to move the sliding valve sleeve 154 downward to its open position so that the valve sleeve ports 184 are aligned with packer mandrel ports 182 to provide communication with the inner bore of the oil well casing below the packing elements 176.

The sliding sleeve valve 154 is opened as follows.

First, the setting tool 10 is once again lifted up until the lower mandrel 138 is pulled completely out of packer mandrel 164. Then, the drill string, upper mandrel 32 and screw jack bushing 70 are rotated through a second predetermined number of revolutions, e.g. twenty revolutions in the preferred embodiment. This moves the annular wedge 54 of cap means 26 into engagement with the keys 74, and the keys 74 are forced radially outward into an enlarged inner diameter portion 208 of releasing sleeve 16. The keys 74 are moved radially outward a sufficient distance to move lower lugs 88 out of engagement with axial grooves 78 so that upper mandrel 32 is free to move both axially and rotationally relative to screw jack bushing 70. Resilient band 104 causes the keys 74 to be retained about lower cylindrical portion 52 of cap means 26 when upper mandrel 32 is released. Sight holes 209 are provided through the sides of releasing sleeve 16 adjacent enlarged inner diameter portion 208 to permit a visual determination of whether keys 74 are in the released position.

Setting tool 10 can be described as a releasably interlocking telescoping tubular assembly. Screw jack bushing 70 is an outer tubular member. Upper mandrel 32 is an inner tubular member, concentrically received within the outer tubular member. The radially spaced keys 74 provide a means for interlocking said outer and inner tubular members to prevent both rotational and axial motion therebetween. Annular wedge 54 provides a means for urging keys 74 radially outward out of engagement with upper mandrel 32. Screw jack means 75 and tubular sleeve assembly 14 provide a means, connected between screw jack bushing 70 and wedge 54, for forcing wedge 54 into engagement with keys 74 to release upper mandrel 32.

Next, setting tool 10 is lowered until lower support surface 194 engages upper end 196 of packer mandrel 164.

When this is done, lower mandrel 138 engages sliding valve sleeve 54 and generally moves it to the fully open position illustrated in FIG. 1E.

When support surface 194 is in engagement with upper end 196 of packer mandrel 164, the maximum load which can be transmitted to the sliding valve sleeve 154 and the lower end of the packer mandrel 164 is equal to the load required to fully compress spring means 160. All additional weight which is set down on setting tool by the drill string is carried by the upper end 196 of packer mandrel 164.

After it has been set within the oil well casing, the packer mandrel 164 is supported relative to the oil well casing by an upward facing shoulder 210 of upper slip assembly 172. Upper facing shoulder 210 may be referred to as a point of axial support of packer mandrel 164. Upper end 196 is located above shoulder 210 so that the additional weight set down by the drill string in excess of that which may be transmitted through spring means 157 is carried by packer mandrel 164 in compression across that portion of packer mandrel 164 between upper end 196 and shoulder 210.

With this design, the tensile loads which may be exerted across the packer mandrel are governed and kept below any load that would cause failure. Therefore, the packer mandrel 164 can now be overloaded to failure only if it is so loaded that it fails in compression. The compression loading which can be carried by packer mandrel 164 is generally on the order of 120,000 pounds. A downward load of 60,000 pounds is generally sufficient to assure operation of the setting tool 10 to open the sliding sleeve valve 154. The weight set down on the drill string can be controlled within sufficiently small tolerances about that level so there is relatively little danger of exceeding the allowable compression load of the packer mandrel 164, when attempting to set down a load of approximately 60,000 pounds.

The resilient spring means 157 is designed to have a travel of approximately $\frac{3}{8}$ to $\frac{1}{2}$ inch. The axial length of spring 157 when it is fully compressed is referred to as a fully compressed height of spring means 157. The sliding valve sleeve ports 184 and the packer mandrel ports 182 are so dimensioned that if sliding valve sleeve 154 is a bit sticky within packer mandrel 164, and resilient spring 157 is held in its fully compressed position, there will be some communication between sliding valve sleeve ports 184 and packer mandrel ports 182 so that sufficient flow area is provided therebetween for the carrying out of the desired cementing or other operations. This position of the valve, with spring means 157 fully compressed, is referred to as the minimum valve open position. In this minimum open position, when support surface 194 is in engagement with upper portion 196 of packer mandrel 164 and spring means 157 is fully compressed, lower mandrel 138 extends below said support surface 194 a distance sufficient to maintain valve sleeve 154 in said minimum open position.

It is sometimes desirable to use the load transfer means 111 and lower mandrel 138 without the remainder of the setting tool 10. Such may be desired when the packer 12 has previously been set and it is merely necessary to open or close the sliding valve sleeve 154. In such a situation, a coupling guide (not shown) is attached to the drill string and provides a threaded connection for connection to threaded upper end 110 of load transfer mandrel 112 as will be understood by those skilled in the art. The load transfer means 111 and lower mandrel 138 may then be used to actuate the sliding valve sleeve 154 in the same manner as was described above with regard to the situation after the keys 74 had been moved out of engagement with upper mandrel 32. Regardless of whether load transfer means 111 directly attached to the upper mandrel 32 or to a coupling guide or to some other intermediate structure, the load transfer means 111 is ultimately connected through that intermediate sturcture to the drill string so that load transfer means 111 may be raised and lowered by raising and lowering the drill string.

In contrast to the operation described above, the prior art setting tool without the load transfer means 111 operates as follows. When the drill string is set down to open the sliding valve sleeve 154, all of the weight set down by the drill string is transmitted to the lower mandrel 138 and to the sliding valve sleeve 154. Valve sleeve 154 is supported by packer mandrel 164 at a lower upward facing annular shoulder 212 located below upward annular upward facing shoulder 210, so that the packer mandrel 164 carries the weight set down by the drill string in tension across that portion of packer mandrel 164 between shoulders 210 and 212. The allowable tensile load for packer mandrel 164 is on the order of 30,000 pounds. The weight which is set down by the drill string is very difficult to control since the drill string, having a length of 10,000 feet or more, weighs many times that amount. It, therefore, often happens that an excess amount of weight is set down on the prior art setting tool and the packer mandrel 164 is pulled apart due to the excessive tensile loading. Packer mandrel 164 generally fails along a plane indicated by the numeral 214.

It is seen, therefore, that the setting tool of the present invention, including the load transfer means 111, converts the load carried by packer mandrel 164 from the least desirable load, i.e. a tensile load, to the most desirable load, i.e. a compression load, on the packer mandrel 164. The result is fewer broken packer mandrels in field operation.

Thus, it is seen that the setting tool of the present invention is well adapted to attain the ends and advantages mentioned as well as those inherent therein. Although specific embodiments of the invention have been illustrated for the purpose of this disclosure, many variations upon those embodiments will be apparent to those skilled in the art and are within the scope and spirit of this invention as defined by the appended claims.

What is claimed is:

1. An actuating tool apparatus for actuating a valve of a downhole mechanism, said downhole mechanism including a downhole mechanism mandrel with a sliding valve sleeve disposed therein, said actuating tool apparatus comprising:

an actuating mandrel, for insertion in said downhole mechanism mandrel and engagement with said valve sleeve to selectively vary said sleeve between a closed position and an open position; and a load transfer means including:

a load transfer casing adapted for connection to a pipe string and having a support surface constructed for engagement with an upper portion of said downhole mechanism mandrel located above a point of axial support of said downhole mechanism mandrel, so that said support surface may transfer a weight of said pipe string to said upper portion of said downhole mechanism mandrel when said pipe string is lowered to move said actuating mandrel and valve sleeve downward so that the weight of said pipe string is supported in compression by said downhole mechanism mandrel; and resilient means, connected between said load transfer casing and said actuating mandrel, for urging said actuating mandrel and valve sleeve downward when said support surface is in engagement with said upper portion of said downhole mechanism mandrel.

2. Apparatus of claim 19, wherein:

said load transfer casing is a cylindrical casing having an inner cavity communicating with a lower end thereof;

an upper end of said actuating mandrel is received in said cavity; and said resilient means is a resilient spring means, located within said cavity between said load transfer casing and said upper end of said actuating mandrel, for urging said actuating mandrel downward relative to said load transfer casing.

3. Apparatus of claim 2, wherein:

said spring means has a fully compressed height such that when said support surface is in engagement with said upper portion of said downhole mechanism mandrel and said spring means is fully compressed, said actuating mandrel extends below said support surface a distance sufficient to maintain said valve sleeve in a minimum open position providing fluid communication between a valve sleeve port and a downhole mechanism mandrel port.

4. Apparatus of claim 2, wherein:

said support surface of said load transfer casing is an annular downward facing surface, and said upper portion of said downhole mechanism is an annular upper end surface of said downhole mechanism mandrel.

5. Apparatus of claim 2, wherein:

said cavity within said load transfer casing is an axially disposed cylindrical shaped cavity;

said load transfer means further comprises a cylindrical extension projecting axially downward, within said cavity, from an upper end of said load transfer casing;

said spring means is disposed concentrically about said extension; and said upper end of said actuating mandrel is received within said cylindrical cavity, and said actuating mandrel has an axial bore disposed therein closely receiving said cylindrical extension.

6. A setting tool apparatus for a packer, said setting tool apparatus comprising:

a tubular sleeve assembly;

an upper mandrel, disposed within said sleeve assembly;

a lower mandrel, including a means for engagement with a sliding sleeve valve of said packer;

load transfer means, connected between said upper and lower mandrels, for governing a maximum downward force which can be applied to said lower mandrel;

screw jack means, connected between said upper mandrel and said sleeve assembly, for producing axial movement of said sleeve assembly relative to said upper mandrel when said upper mandrel is rotated within said sleeve assembly; and drag means, connected to said sleeve assembly, for preventing rotation of said sleeve assembly when said upper mandrel is rotated.

7. Apparatus of claim 6 in combination with said packer, wherein:

said apparatus is so constructed that, when said load transfer means is connected to said packer, and when said upper mandrel is rotated a first predetermined number of revolutions, said sleeve assembly is forced into engagement with said packer to set an upper slip means of said packer.

8. Apparatus of claim 7, further comprising:

locking means, connected between said upper mandrel and said screw jack means, for preventing sliding and rotational movement of said upper mandrel relative to said sleeve assembly; and means for releasing said locking means when said upper mandrel is rotated a second predetermined number of revolutions, so that said sleeve assembly may move upward relative to said lower mandrel to permit said lower mandrel to engage said sliding sleeve valve of said packer.

9. Apparatus of claim 8, wherein:

said locking means includes a key engaging a slot disposed in said screw jack means and a groove disposed in said upper mandrel; and said releasing means includes a wedge means arranged to move said key out of engagement with said groove when said upper mandrel is rotated through said second predetermined number of revolutions.

10. A setting tool apparatus in combination with a packer, said setting tool apparatus comprising:

a tubular sleeve assembly;

an upper mandrel, disposed within said sleeve assembly;

a lower mandrel, including a means for engagement with a sliding sleeve valve of said packer; and load transfer means, connected between said upper and lower mandrels, for governing a maximum downward force which can be applied to said lower mandrel, said load transfer means including:

a load transfer casing, connected to said upper mandrel, and having a support surface for engagement with said packer; and resilient means, connected between said load transfer casing and said lower mandrel, said resilient means being constructed so that when said support surface is in engagement with said packer the downward force applied to said lower mandrel must be transmitted through said resilient means.

11. Apparatus of claim 10, wherein:

said resilient means is a resilient spring means, and said maximum downward force which can be applied to said lower mandrel is equal to a force required to fully compress said spring means.

12. A load transfer device, comprising:

a first mandrel, having an upper cylindrical portion for connection to a drill string, a middle radially outward projecting shoulder located below said upper portion, and a lower cylindrical portion located below said shoulder, said first mandrel having an axial bore therethrough for communication with an inner bore of said drill string;

an upper casing portion, having an axial bore therethrough receiving said upper cylindrical portion of said first mandrel, and having an axial counterbore receiving said shoulder of said first mandrel;

a lower casing portion, connected to said upper casing portion, having an axial bore with upper and lower counterbores disposed therein;

a second mandrel, having a radially outward projecting flange at a first end thereof, said second mandrel being received in said axial bore of said lower casing portion and said flange being received in said upper counterbore of said lower casing portion, said mandrel further including at a second end thereof a packer valve engaging means, and said second mandrel having an axial bore therethrough for closely receiving said lower cylindrical portion of said first mandrel; and resilient spring means, disposed between said shoulder of said first mandrel and said flange of said second mandrel, for urging said second mandrel downward relative to said first mandrel.

13. A releasably interlocking telescoping tubular assembly comprising:

an outer tubular member;

an inner tubular member, concentrically received within said outer tubular member;

a plurality of radially spaced keys, interlocking said outer and inner tubular members to prevent both rotational and axial motion therebetween;

wedge means, for urging said keys radially outward out of engagement with said inner tubular member; and means, connected between said outer tubular member and said wedge means, for forcing said wedge means into engagement with said keys to release said inner tubular member.

14. Apparatus of claim 13, wherein:

said outer tubular member has a plurality of radially spaced axial slots disposed therein;

said inner tubular member has first and second axially spaced annular grooves disposed in an outer surface thereof, with a plurality of radially spaced axial grooves interconnecting said annular grooves; and said keys are located radially outward of said outer tubular member and include radially inward projecting lugs positioned through said slots of said outer tubular member and in said axial grooves of said inner tubular member to interlock said tubular members.

15. Apparatus of claim 14, wherein:

said means for forcing said wedge means includes a threaded screw jack for axially moving said wedge means into engagement with said keys when said outer tubular member is rotated through a predetermined number of revolutions relative to said wedge means.

16. Apparatus of claim 15, wherein:

said wedge means is an annular wedge; and said telescoping tubular assembly further includes a resilient band, placed about radially outer surfaces of said keys to urge said keys radially inward, so that when said wedge means is moved into engagement with said keys, said band retains said keys about said wedge means after said inner tubular member is released.

* * * * *

UNITED STATES PATENT AND TRADEMARK OFFICE

CERTIFICATE OF CORRECTION

PATENT NO. : 4,253,521

DATED : March 3, 1981

INVENTOR(S) : Ronald E. Savage

It is certified that error appears in the above-identified patent and that said Letters Patent are hereby corrected as shown below:

Column 10, line 35, delete "19" and insert -- 1 --.

Signed and Sealed this

*Ninth* Day of *June 1981*

[SEAL]

*Attest:*

RENE D. TEGTMEYER

*Attesting Officer*

*Acting Commissioner of Patents and Trademarks*